United States Patent [19]

Lake

[11] 4,352,427

[45] Oct. 5, 1982

[54] STACKABLE EGG CARTON HAVING OVERWRAP OVER EGGS SUFFICIENTLY TAUT TO RIGIDIFY CARTON

[75] Inventor: Connie Lake, Tinley Park, Ill.

[73] Assignee: S. Eisenberg & Co., Division of Creative Industries, Inc., Bridgeview, Ill.

[21] Appl. No.: 215,110

[22] Filed: Dec. 10, 1980

[51] Int. Cl.[3] ..... B65D 65/16; B65D 81/16; B65D 85/32

[52] U.S. Cl. ..... 206/45.33; 229/2.5 EC; 229/44 EC; 206/506

[58] Field of Search ..... 229/2.5 EC, 44 EC, 45 EC; 217/26.5; 206/45.33, 506

[56] References Cited

U.S. PATENT DOCUMENTS

| | | | |
|---|---|---|---|
| D. 202,451 | 9/1965 | Swaim et al. | D58/13 |
| D. 214,664 | 6/1969 | Edwards | D9/190 |
| D. 252,179 | 6/1979 | Cherry et al. | D7/76 |
| 3,086,646 | 4/1963 | Meyers | 206/45.33 |
| 3,192,050 | 6/1965 | Almquist | 206/45.33 |
| 3,288,347 | 11/1966 | Commisso et al. | 206/45.33 |
| 3,556,387 | 1/1971 | Trimble | 229/2.5 EC |
| 3,675,806 | 7/1972 | Noguchi | 217/26.5 |
| 3,877,599 | 4/1975 | Morris | 217/26.5 |
| 4,087,040 | 5/1978 | Bessett et al. | 229/2.5 EC |
| 4,230,258 | 11/1980 | Lane | 229/30 |

FOREIGN PATENT DOCUMENTS

| | | | |
|---|---|---|---|
| 294639 | 9/1969 | Australia | 229/44 EC |

*Primary Examiner*—William Price
*Assistant Examiner*—Gary E. Elkins
*Attorney, Agent, or Firm*—Hill, Van Santen, Steadman, Chiara & Simpson

[57] ABSTRACT

Carton for eggs and the like including a tray section having rows of generally conical cavities with ovate sidewalls and corner bolsters hinged to opposite sides of the carton and connected together by side panels hinged along the same side lines as the bolsters and extending partially upwardly of the articles in the cavities when the bolsters are hinged upwardly to cover the corner articles in the carton. Stops spaced inwardly of the hinge lines extend upwardly of opposite edges of the carton and afford support for the side panels and limit inward movement thereof as the bolsters are moved to protect the articles in the corners of the carton.

When the tray is loaded with eggs, it is placed in a plastic bag which is heat shrunk to the carton to rigidify the carton. The heat of shrinking seals the open end of the bag as the open end is drawn together by the heat shrinking operation. The corner bolsters enable ready stacking of the cartons one on top of the other with the eggs in the top carton spaced above the eggs in the lower carton.

7 Claims, 9 Drawing Figures

STACKABLE EGG CARTON HAVING OVERWRAP OVER EGGS SUFFICIENTLY TAUT TO RIGIDIFY CARTON

BACKGROUND OF THE INVENTION

Heretofore molded cartons for fragile articles, such as eggs, have included a tray section having cavities for the articles to be packaged and have been provided with a cover section hinged to the tray section and completely covering the eggs or other articles contained in the carton. Such cartons are usually molded from a foam plastic material, but may be molded from pulp or other moldable materials. The cover section extending entirely over the tray section is detachably locked to the tray section by various types of molded locks, interengageable between the cover section and the tray section.

While such locks may lock the cover section to extend over the tray section, the cover section completely covers the articles contained in the carton, tempting a prospective purchaser to release the lock of the cover section to handle the eggs or other articles which may be contained in the carton. This is a disadvantage since the cover section frequently is left unlocked by the prospective purchaser and reduces the desirability of displaying the cartons when loaded with eggs for sale and affords only nominal protection to the eggs or other articles contained in the carton.

While such cartons are used for eggs they normally contain only a dozen eggs due to lack in rigidity of the carton and unless the carton is made of a heavier gauge than normal, which increases the expense of molding the carton, it could not economically be enlarged to contain more than one dozen eggs.

Molded cartons for eggs and the like have also been made, having an overwrap enveloping the carton. The carton has side panels hinged to the side edges of the carton and extending above the tops of the eggs in the carton and enveloped in a shrink film held out of contact with the eggs by the panels.

By my present invention, bolsters extend over the articles in the carton at each corner of the carton and are hinged to the sidewalls of the carton and extend upwardly of the articles carried in the carton, and side panels connect said bolsters together but stop short of the tops of the bolsters and articles carried in the carton. The bolsters are hinged to extend over the articles carried in each corner of the carton, and the side panels connecting the bolsters together extend upwardly of the top surface of the carton, along the eggs or other articles carried thereby, but terminate short of the tops of the eggs or other articles carried by the carton.

A carton when loaded is slipped into a plastic bag which may be a polyvinyl or PCV bag of a type which will contract when heated. The bag forms an overwrap extending over the tops of the bolsters and is passed through a heat shrink oven or tunnel and then cooled. The heating shrinks the overwrap to the extent that it is sufficiently taut to retain the bolsters into engagement with the top surface of the carton and to rigidify the carton so the carton when filled with eggs or other articles may readily be handled and observed by the purchaser of the eggs. The carton and eggs are then immediately passed to a refrigerated medium. The side panels are rigidified and further limited from inward movement toward the eggs by embossments projecting upwardly of the side edges of the carton.

An advantage of the invention is that the corner bolsters and heat shrink film provide a rigid carton capable of holding more than the usual dozen of eggs, without deforming the carton when handled, or rendering the eggs subject to breakage when stacking the cartons.

A further advantage of the invention is that the corner bolsters enable ready stacking of the cartons one on top of the other when filled with eggs and retain the eggs in one carton out of contact with the eggs in the carton thereabove.

Other advantages and objects will appear from time to time as the following specification proceeds and with reference to the accompanying drawings wherein:

DESCRIPTION OF INVENTION

Figure 1:
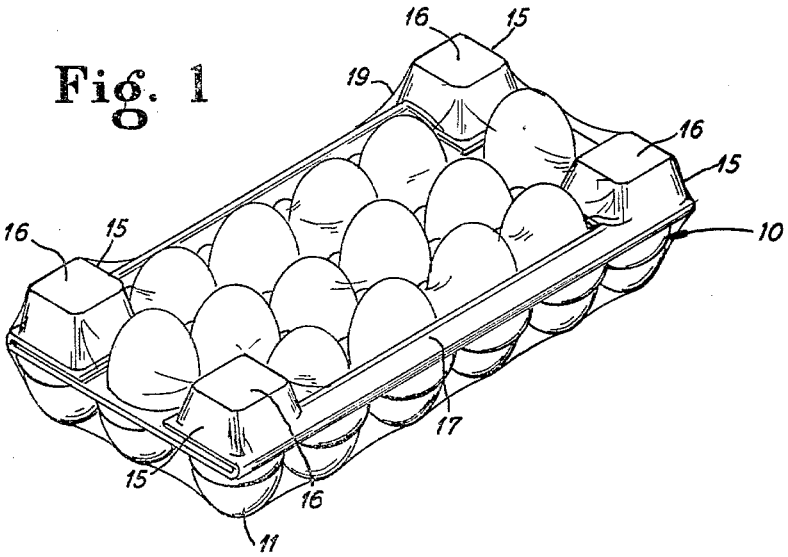
FIG. 1 is a perspective view of a carton constructed in accordance with the principles of the present invention, filled with eggs and enrobed and rigidified by a heat shrink film.
Figure 2:
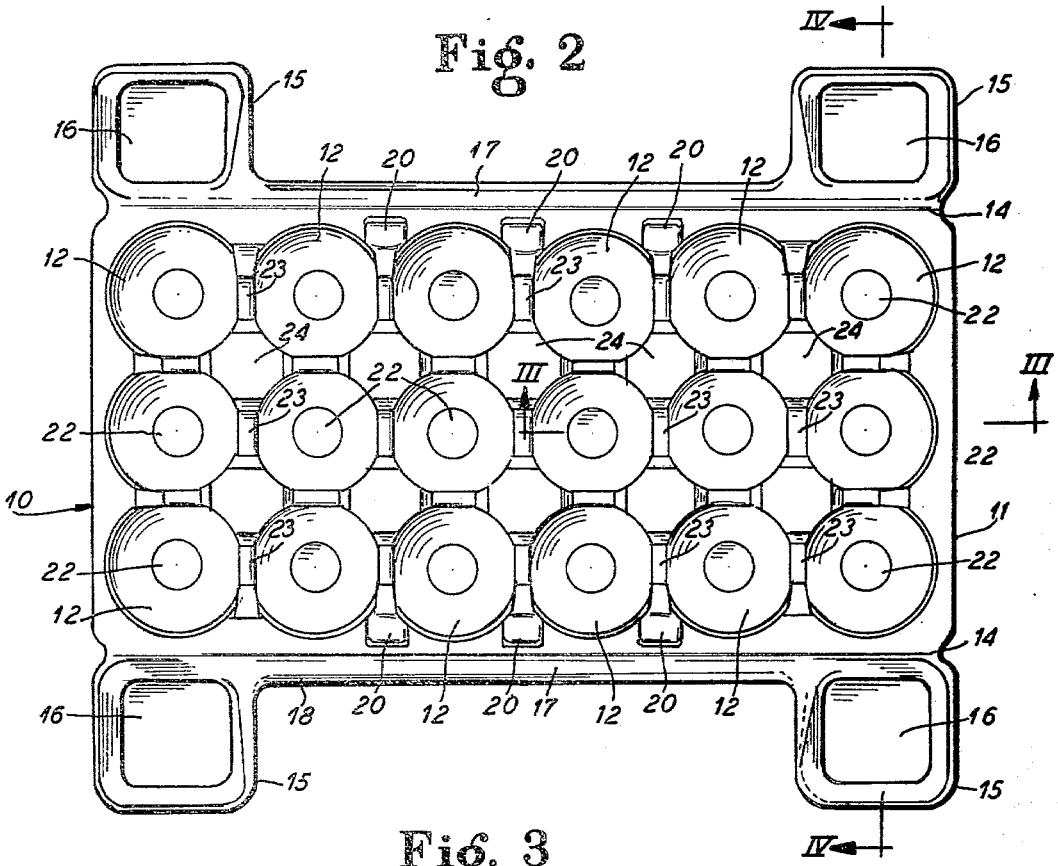
FIG. 2 is a plan view of the carton shown in FIG. 1 showing hinged corner bolsters and side panels connecting the bolsters together in an open position prior to filling the carton with eggs.
Figure 4:
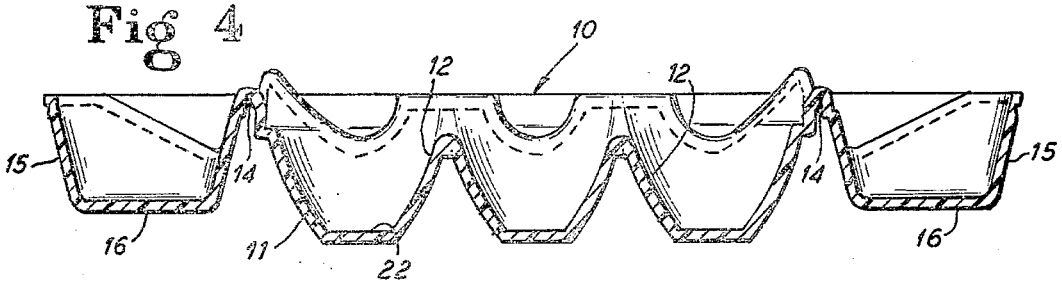
FIG. 4 is an end view of the carton shown in FIG. 2.

In the embodiment of the invention illustrated in the drawings I have shown in FIGS. 1, 2 and 4, a carton 10, which may be molded from a thermoplastic foam material, such as a polystyrene or polyethylene foam. A polystyrene foam is more commonly used than polyethylene foam or other foam materials, so the material of the carton will hereinafter be referred to throughout the specification as either a foam material or polystyrene foam, although the invention is not intended to be limited to polysryrene foam. The carton 10 includes a tray section 11 having a plurality of egg receiving cavities 12 therein, herein shown as being eighteen in number. The cavities 11 need not necessarily be eighteen in number but may be of any number required to hold a selected number of eggs, and may be twenty four or more in number where desired.

At each corner of the tray section 11 and hinged to opposite sides of the carton along hinge lines 14 are corner covers or bolsters 15. Said hinge lines 14 are formed by indentations along opposite sides of the tray section 11. Said bolsters are pivotally movable relative to the sides of the tray to extend over and cover the corner cavities 12 and protect the eggs or other article, in each corner cavity, and each have a flat top 16 spaced above the egg carried in the respective cavity 12 when the carton is closed. The bolsters 15 are connected together by side panels 17, hinged to opposite sides of the carton along the hinge lines 14, and extend upwardly along the bolsters when in their protective position for a portion of the height of said bolsters and stopping short of the tops of the eggs carried in the cavities 12. Said side panels have lips 18 engaging the eggs and serve to protect and retain the eggs to the side cavities 12 and hold a thin plastic overwrap 19 in spaced relation with respect to the sides of the eggs as the overwrap is stressed to rigidify the carton as the overwrap is shrunk to extend over the eggs and thereby retain the eggs in the cavities of the tray section. The overwrap may be made from a thin PVC plastic or equivalent plastic material commonly used as an overwrap for cartons.

Stops 20 in the form of embossments molded during molding of the carton, extend upwardly of the side margins of the carton inwardly of the hinge lines between the cavities 12 and limit inward movement of said side panels 17.

Figure 3:
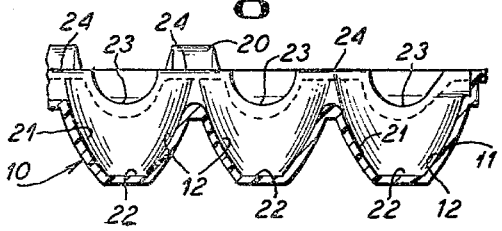
FIG. 3 is a sectional view taken substantially along line III—III of FIG. 2.
Figure 5:
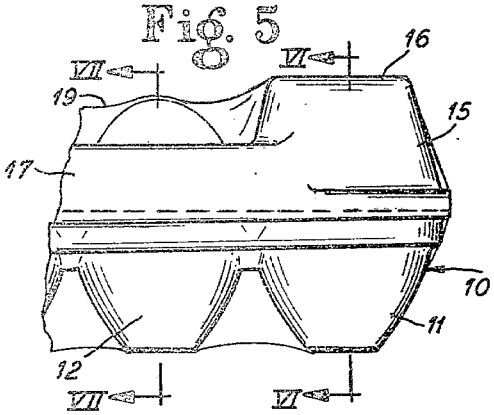
FIG. 5 is a fragmentary side view of the carton shown in FIG. 1 drawn to an enlarged scale, filled with eggs and enrobed in a plastic film.

Each cavity 12 is shown in FIGS. 3, 4 and 5 as being generally frusto-conical in form with ovate or curved sidewalls 21 forming the sidewall of the cavity and generally conforming to the form of the articles to be carried therein to retain the articles to rest on a flat bottom 22 of each cavity.

The frusto-conical sidewalls of each cavity terminate in the form of upwardly facing arcuate recesses 23 affording ready access to the eggs carried in the respective cavities. The arcuate portions 23 also terminate at their adjacent ends into flat relatively square abutment surfaces 24, the end abutment surfaces of which may form stops for the corner bolsters of the carton.

Figure 6:
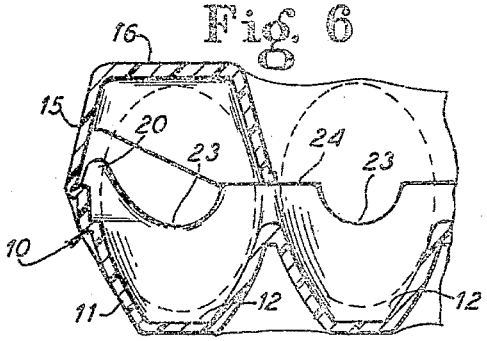
FIG. 6 is a fragmentary sectional view taken substantially along line VI—VI of FIG. 5.
Figure 7:
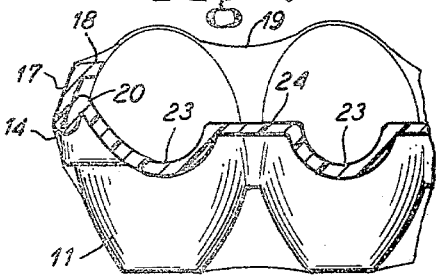
FIG. 7 is a fragmentary sectional view taken substantially along line VII—VII of FIG. 5.

A carton as shown in FIGS. 2 and 4 may be loaded with eggs, with an egg in each cavity 12 as shown in FIGS. 6 and 7. The bolsters and side panels 17 may then be hinged inwardly along the hinge lines 14 to extend over the end eggs in the carton in protective relation with respect to each corner egg in the carton. With the bolsters 15 in their closed positions over the eggs the carton may be placed into the overwrap 19 shown as an elongated thin plastic bag, close to the closed end of the bag, with an overlap of the bag at the opposite end of the carton from the end adjacent the closed end of the bag, sufficient to accommodate shrinkage of the open end of the bag and sealing thereof as the carton is passed through the heat shrink tunnel or oven 26 and then cooled.

Figure 9:
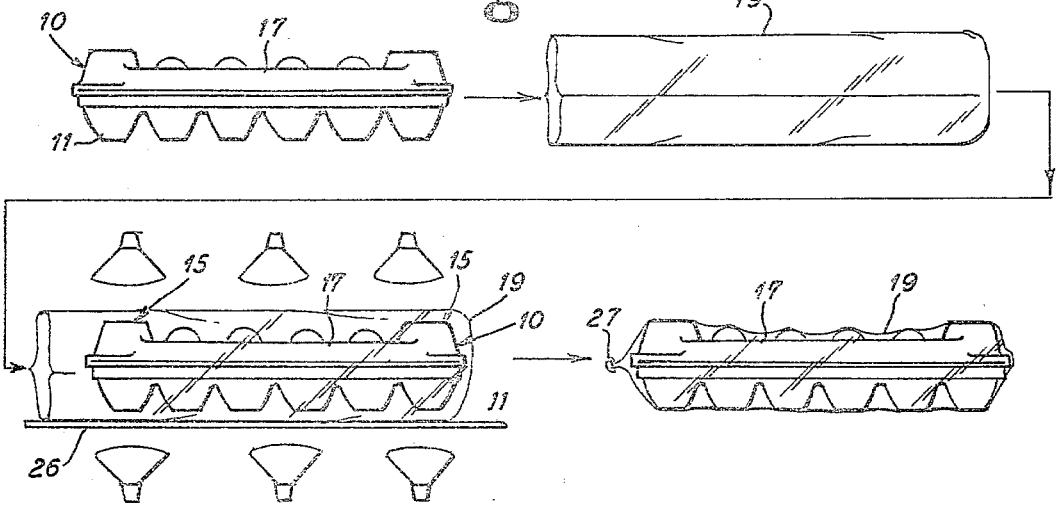
FIG. 9 is a diagrammatic view diagrammatically showing the enrobing of a carton filled with eggs in a plastic film or bag.

In FIG. 9 the heat shrink tunnel or oven 26 is diagrammatically shown for illustrative purposes heated by heat lamps, although it is understood that it may be heated in various other conventional ways. The temperature may be as in conventional heat shrink tunnels, which has been found to be sufficient to shrink the bag about the carton and seal the open end of the bag by bringing the open end together along the center of the carton, as indicated by a reference numeral 27, showing the sealed carton leaving the oven and sufficiently taut to form a transparent plastic overwrap for the carton stretched along and across the carton and tops of the eggs therein, to rigidify the carton and retain the eggs thereto.

It should be understood that while the carton 10 in the plastic bag forming the overwrap 25 passes through a relatively hot oven or heat tunnel sufficiently hot to shrink the overwrap to the carton, that the carton is only in the oven or tunnel for a short period of time, which is insufficient to change the character of the eggs in the carton and that the loaded carton with the overwrap 25 heat shrunk thereto is then immediately cooled in a refrigerator or like cooling apparatus.

Figure 8:
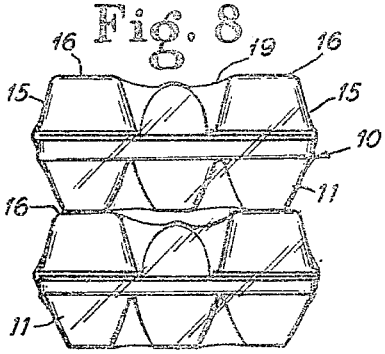
FIG. 8 is a view showing two loaded egg cartons stacked one on top of the other.

It may further be seen from FIG. 8 that since the tops of the bolsters 15 are relatively flat and since the bottoms of the frusto-conical cavities 12 are also relatively flat with the cavities supporting the eggs out of contact with the flat tops 16 of the bolsters, that the overwrap retains the bolsters into engagement with the top of the tray and the eggs to the cavities 12 as shown in FIG. 6. This enables the trays to be readily stacked one on top of the other without the liability of breaking the eggs, and the overwrap not only retains the bolsters in their closed position, but when stretched across the bolsters and carton, rigidifies the carton and makes it possible to provide egg cartons containing more than the usual dozen of eggs.

It should further be understood that while the principles of the present invention may be applied to a carton containing a dozen eggs or three dozen eggs or more, that I do not wish to be limited to cartons containing a specific number of cavities, but wish the invention to be construed to cover cartons having any practical number of cavities desired.

While I have herein referred to the carton as a carton containing eggs, it is understood from the foregoing that the carton may contain various types of fragile articles with no modifications of the principles of the carton, but with the cavities molded to generally conform to the fragile articles to be contained in the carton.

I claim as my invention:

1. A molded plastic carton for eggs or other fragile articles containing the articles to be viewed by the purchaser without opening the carton or touching the articles contained therein, comprising a tray section having a plurality of rows of upwardly opening cells therein, each formed to generally conform to the articles to be carried in the carton, said carton having corner protective and stacking bolsters at each corner thereof, hinged to extend over the corner articles carried in the carton, said cells each being of a lesser depth than the height of the articles carried in the carton, and said tray section having an outer rim extending thereabout, a common integral hinge line extending along said rim along each side of the carton, hinging said bolsters to be pivoted along the sides of the carton to cover the articles in the corner cells thereof, said bolsters being cup-like in form when in open positions and having relatively flat top portions when extending over the corner articles, spaced a substantial distance above the height of the articles carried in the carton, and side panels connecting said bolsters together and hinged to the sides of the carton along the common hinge lines and extending upwardly along said bolsters for a portion of the height thereof and the eggs carried between said bolsters, and stopping short of the tops of said bolsters, embossments extending upwardly of the top rim of the tray section of the carton along the side edges thereof, and limiting inward movement of said side panels connecting the bolsters together, and means retaining said bolsters to extend over the corner cavities when loaded with eggs and retaining said side panels to extend upwardly along the eggs carried in said carton.

2. The molded plastic carton of claim 1, including lips extending inwardly of the upper margins of said side panels and engageable with the eggs in the side cavities when said corner bolsters extend over the eggs in said carton to protect the eggs in the side cavities and retain the eggs thereto.

3. The molded plastic carton to claim 1, including a transparent plastic bag encasing said carton when filled and heated and cooled to shrink and retain said bolsters to cover the corner eggs carried in said carton and retain said panels in engagement with said embossments, said lips on said side panels in engagement with the eggs and said heat shrunk bag and bolsters rigidify the carton, enabling a carton to be molded capable of containing more than a dozen eggs.

4. The molded plastic carton of claim 3, wherein the carton is molded from a foam plastic material and the thin plastic bag heat shrunk to the carton is a thin transparent plastic material shrinking about the carton as heated.

5. The egg carton of claim 1, in which the cavities are generally frusto-conical in form, in which the sides of the frustums of the cones are ovate in form to generally conform to the eggs carried in the carton, and the bolsters are of a cup-like form when facing upwardly and have top surfaces when inverted, which extend over the eggs and are relatively flat to accommodate stacking of the cartoons one on top of the other.

6. The egg carton of claim 5, wherein the heat shrunk overwrap retains the bolsters in position to cover the corner eggs and to retain the lips extending along side panels into engagement with the sides of the eggs in the side cavities, and the embossments limit inward movement of the side panels and bolsters and protect the eggs between said bolsters.

7. The egg carton of claim 6, wherein the tray side panels and bolsters are integrally molded and the overwrap comprises a thin plastic bag open at one end and closed at the opposite end, and of sufficient size to accommodate the carton when filled with eggs to fit therein with the open end of the bag extending beyond the carton and the heat shrinking operation renders the bag taut and exerts tensile stress on the carton and seals the open end of the bag closed.

* * * * *